US005148760A

United States Patent [19]

Miyauchi

[11] Patent Number: 5,148,760

[45] Date of Patent: Sep. 22, 1992

[54] METHOD AND APPARATUS USING CLAMPS AND MOVABLE PLATES FOR PRODUCING PLEATS

[75] Inventor: Takashi Miyauchi, Duluth, Ga.

[73] Assignee: Juki America, Inc., Duluth, Ga.

[21] Appl. No.: 525,489

[22] Filed: May 18, 1990

[51] Int. Cl.[5] ..... D05B 35/08

[52] U.S. Cl. ..... 112/144; 112/146; 112/147; 223/35

[58] Field of Search ..... 112/144, 134, 145, 146, 112/262.1, 147; 223/32, 33, 34, 35

[56] References Cited

U.S. PATENT DOCUMENTS

| | | | |
|---|---|---|---|
| 1,166,237 | 12/1915 | Moffatt | 112/145 |
| 1,231,139 | 6/1917 | Dickman | 223/33 |
| 2,749,858 | 6/1956 | Campbell et al. | 112/145 |
| 3,369,303 | 2/1968 | Henry | 112/146 |
| 3,519,174 | 7/1970 | Ronay | 223/34 |
| 3,760,746 | 9/1973 | Portilla, Jr. | 112/134 |
| 3,850,121 | 11/1974 | Speer | 112/147 |
| 3,889,858 | 6/1975 | Hack | 223/35 |
| 3,918,376 | 11/1975 | Nishiwaki et al. | 112/144 |
| 4,573,421 | 3/1986 | Mall et al. | 112/146 |
| 4,787,325 | 11/1988 | Black et al. | 112/262.1 |

*Primary Examiner*—Werner H. Schroeder
*Assistant Examiner*—Ismael Izaguirre
*Attorney, Agent, or Firm*—Morgan & Finnegan

[57] ABSTRACT

A method and system using an apparatus for folding and sewing a pleat in a material without the need for manual folding. The method includes the use of clamps to hold the material in place and the movement of pleates to fold the material. The pleat is kept in place by a clamp during stitching. The method may be used on any type of pleating operation, but is particularly applicable to the formation of pleats in yoke-back panel material assemblies.

6 Claims, 6 Drawing Sheets

FIG. 9
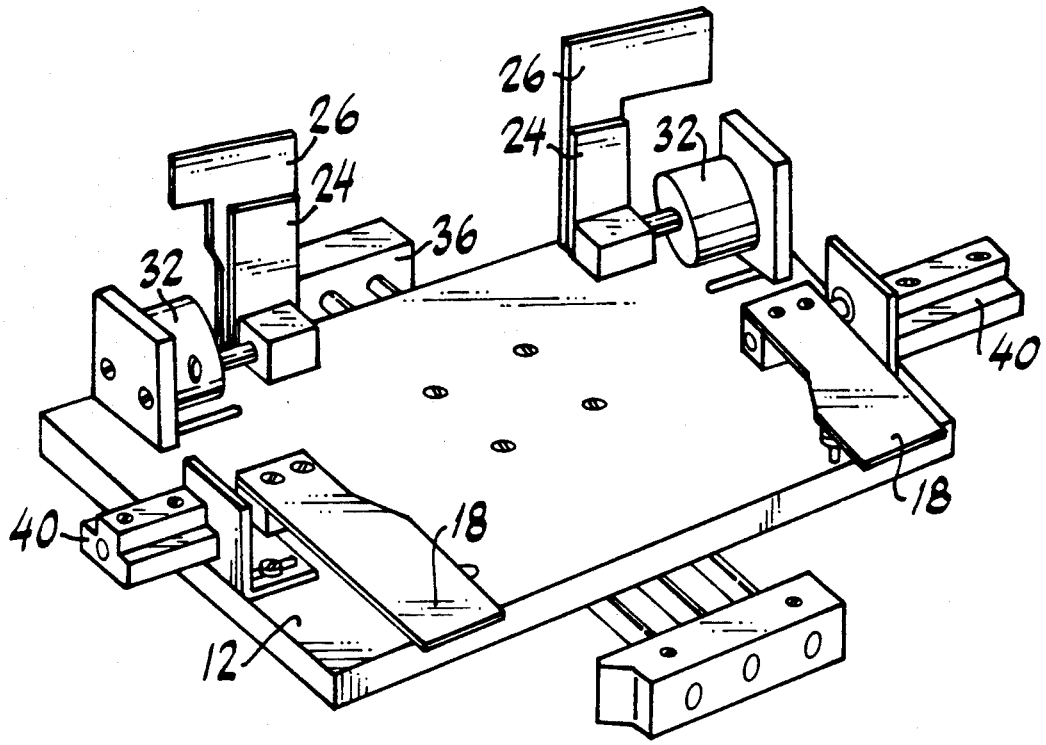
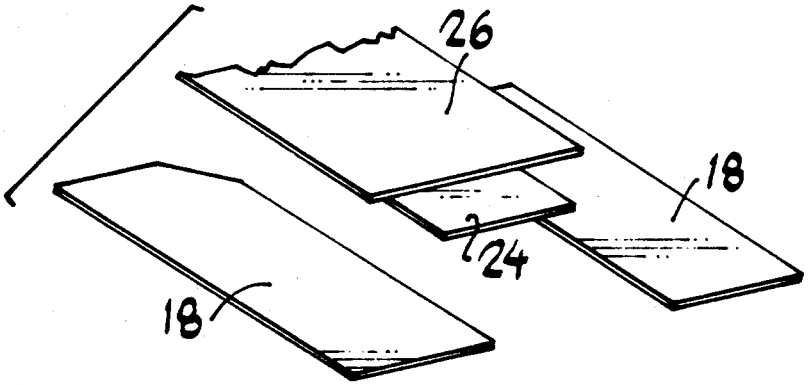
FIG. 10

METHOD AND APPARATUS USING CLAMPS AND MOVABLE PLATES FOR PRODUCING PLEATS

CROSS-REFERENCE TO THE RELATED APPLICATION

This application makes reference to co-pending application Ser. No. 525,898 filed on May 18, 1990, now U.S. Pat. No. 5,097,776, the content of which is incorporated herein by reference.

BACKGROUND OF THE INVENTION

1. Field of the Invention

This invention relates generally to methods and apparatus for pleating materials. More particularly, the invention relates to a method and an apparatus for the manufacture of pleated yoke and back panel shirt assemblies.

2. Description of the Related Art

One of the more difficult operations in sewing is the formation of a pleat. Conventional technology utilizes manual means for folding a pleat in material and for feeding the arrangement through a sewing machine where the pleat is sewn in position. In situations where the operator is forming a pleat in a shirt back panel material, the difficulty is even more pronounced. The back panel material, in many instances, is attached to yoke panel materials used to form the shoulder portion of the shirt. Generally, two yoke panel materials are attached to each back panel material. The multiple panel materials used in such pleating operations add to the complexity of the pleating and sewing operations.

Traditionally, an operator manually folds the back panel material to form a pleat, or a series of pleats depending on the design of the shirt. Next, the operator manually feeds the two yoke panel materials and the pleated back panel material together through a sewing machine where one yoke panel material would be sewn onto either side of the back panel material. After the operator is finished sewing, the back panel material-yoke panel material assembly is transferred to the next station where other sewing necessary in the production of the shirt takes place.

This manual aligning of the yoke and back panel material and the manual feeding of the materials to the sewing operation has drawbacks. For instance, it is important for the lines in the pleat to be accurate and parallel for the shirt to be considered of high quality and good workmanship. The manual nature of this work increases the possibility that the pleat might be inaccurate or not parallel.

In addition, manual alignment of the back and yoke panel materials requires the manufacturer to invest essential man hours in this operation. It takes some time to position the material with the pleat in the correct place and to then feed the configuration in a fashion that is careful enough not to change the accuracy or parallelness of the pleat during the sewing process. Typically, the operator has to finish folding, feeding and sewing one set of materials before the operator can start the process again with new materials.

The difficulty of the pleating process varies with the type of materials used. As the thickness of the material increases, it becomes more difficult to manually fold the material and hold in place during the sewing process. It also becomes more difficult to handle yoke and back panel material as the size of the panel materials becomes increasingly small or increasingly large.

In working with yoke and back panel materials, it is also difficult to form and keep a pleat in the back panel material during the sewing process while keeping the yoke panel material flat and unwrinkled. Typically, the operator will start with the yoke and back panel materials aligned evenly across their widths and then have to create a pleat in the back panel material as it sets between the two yoke panel materials. This tedious operation sometimes requires the operator to release the yoke panel materials in order to form an accurate and parallel pleat. When the yoke panel materials are released, there is a possibility that the alignment will be altered and that the operator will have to either begin the process again or risk sewing the panel materials into an inaccurate and unacceptable configuration.

Further, due to the nature of the work, it is advantageous to have experienced operators work on this portion of the shirt production operation. However, the need for such experienced people at this point in the operation detracts from the other points in the production operation where the experienced operator could be of value. In addition, the experience necessary to complete the pleating function creates a barrier to the use of unexperienced workers.

Accordingly, it is an object of this invention to provide a means for automatically making a pleat.

It is also an object of this invention to provide an automatic pleat forming mechanism adaptable for forming a variety of types of pleats in materials of various sizes and thickness.

It is another object of this invention to provide a means for making a pleat which reduces manual labor and increases accuracy.

It is a further object of the invention to provide a means for pleating that reduces the cycle time for forming and sewing pleats.

It is a further object of this invention to reduce the skill level normally necessary in manually forming a pleat.

SUMMARY OF THE INVENTION

The above-mentioned and other objects of the invention are met by a pleating method and apparatus according to the present invention. In a preferred embodiment, a method and apparatus for forming the pleat, in accordance with the invention, includes a folding plate positioned below the material to be pleated. After a material is in position, it is clamped down by a lower plate that forces a portion of the material below the folding plate. At the same time, an upper plate clamps the material against the folding plate.

After all of the plates are in position, the folding plate is moved a predetermined distance across the lower plate, thus folding the material and forming a pleat. The upper plate provides a frictional resistance that regulates the movement of the material as the folding plate is moved. The upper plates ensure that the pleated material remains flat and unwrinkled during the pleating process.

After folding, the clamps are applied to hold the panel materials and the pleat in place and then the upper, lower, and folding plate are removed. While still clamped in the pleated configuration, the material may be transported to a sewing location and the pleat is sewn in place.

The number of folding plates, lower plates and upper plates, along with the position of the plates relative to the width of the material used, will depend on the style of the pleat desired and the number of such pleats. Typically, in the center pleated shirt, two folding plates in close proximity to each other are used, with one upper and one lower plate. Conversely, pleats formed on the sides of a shirt require the us of two folding, two upper and two lower plates.

BRIEF DESCRIPTION OF THE DRAWINGS

The above and other objects, features and advantages of this invention will be apparent from the following detailed description, especially when taken in conjunction with the accompanying drawings.

FIG. 9 is a perspective view of a pleating unit for forming two-fold, side pleats;

FIG. 10 is a perspective view of the folding plates and the members of the swing plate assembly used to form four-fold pleats;

DESCRIPTION OF THE PREFERRED EMBODIMENTS

Figure 8:
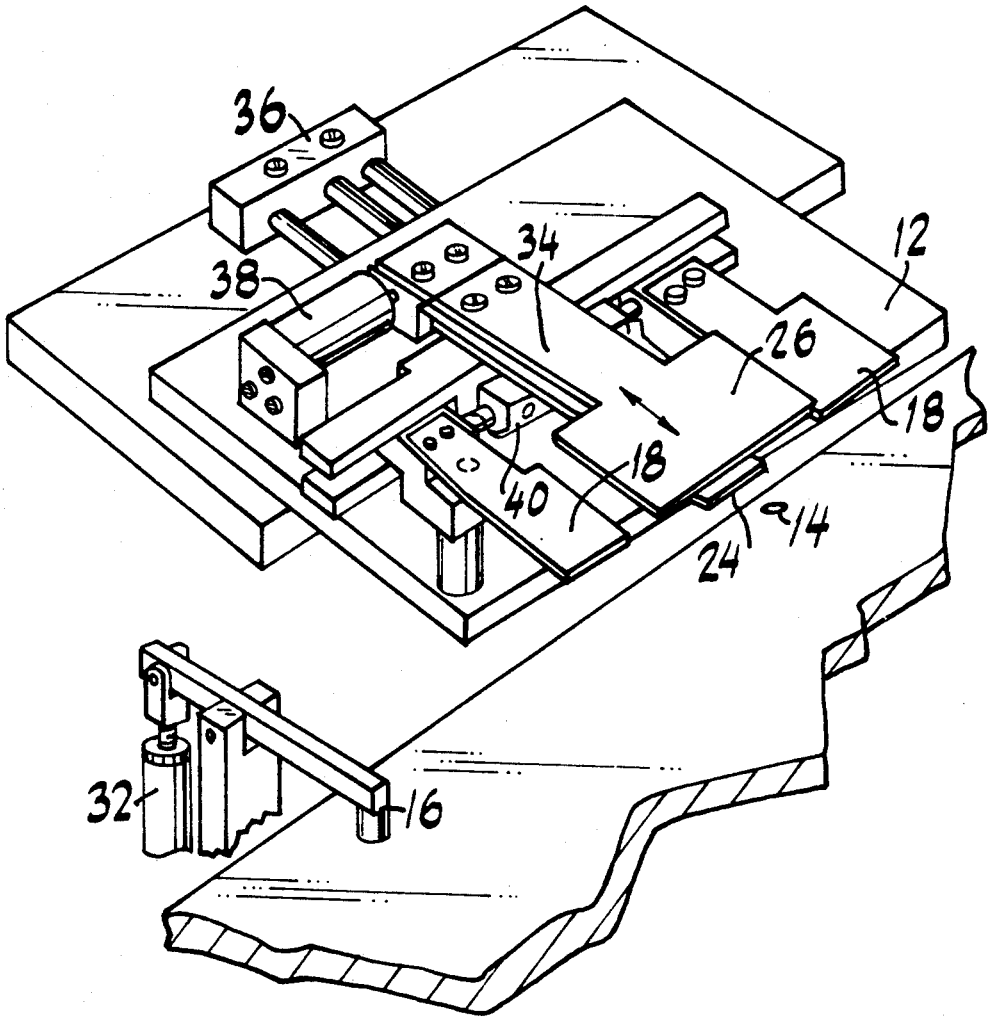
FIG. 8 is a perspective view of a pleating unit for forming four-fold, center pleats.

Referring to the drawings, preferred embodiments of a pleat forming apparatus, according to the present invention, are illustrated in FIGS. 8 and 9.

FIG. 8 shows the mechanism used to form four-fold center pleats. In this particular embodiment, clamps 16 are engaged and disengaged by actuators 32. Clamps 16 and the means for their engagement, are preferably attached to base plate 12. Clamps 16 are best positioned to secure a material, thereby being out of the area where the subsequent folding (pleating) operations will take place. The use of clamps 16 at either edge of the material better ensures that material, as well as other subsequent materials, will be immobilized during the necessary periods of the pleating operation.

Folding plates 18 are used to form the pleat in the material secured by clamps 16. Folding plates 18 are maneuvered by actuators 40. As folding plates 18 move toward each other, material positioned in between folding plates 18 may be folded when the material is secured in the appropriate locations. It is preferable that the means of moving folding plates 18 to form the pleat be attached to base plate 12.

Sensor 14 is located in a position to detect the presence of material over base plate 12. Sensor 14 may be used to activate the means to engage clamps 16 and to position folding plates 18. Alternatively, the operator may manually activate the engaging and positioning means or some other type of activator may be used.

Lower plate 24 and upper plate 26 together form a swing plate assembly 34. Swing plate assembly 34 is rotated into position by actuator 38. It is preferable that lower plate 24 and upper plate 26 engage the material present in a manner as not to cause great disturbance in the consistency of the material, i.e. engaging lower plate 24 and upper plate 26 should not cause excessive wrinkles in or misalignment of the material. Lower plate 24 secures the material in preparation for the movement of folding plates 18 while upper plate 26 provides a frictional resistance to the movement.

Although the embodiment of FIG. 8 discloses actuator 38 for maneuvering the swing plate assembly 34 into position, other mechanism for moving swing plate assembly 34 may be provided. Such maneuvering means (e.g. belts, pulleys, or actuators) will preferably be attached to base plate 12.

FIG. 10 is an illustration of the folding plates 18, Upper plate 26, lower plate 24 according to one embodiment of the invention. This embodiment is used for the formation of a four-fold center pleat in a yoke-back panel assembly. Representative dimensions of this embodiment are as follows: folding plates 18—width 32 mm; upper plate—width 60 mm; and lower plate—width 37.8 mm. These dimensions, however, will be dependent on the requirements of the specific shirt design.

Lower plate is preferably slightly thicker in construction than upper plate since lower plate 24 must secure the material securely against the surface below it. On the other hand, upper plate 26 must, in a spring-like manner, allowing the material to move later in the process as lower plate 24 clamps the material, and as the pleat is being formed. In addition, upper plate 26 must overlap with folding plates 18 a distance sufficient enough to control the potential for buckling while the material is in motion. Upper plate 26 may thus be constructed as a flexible swing plate.

The pleating unit, including the swing plate assembly 34 (lower plate 24 and upper plate 26) and folding plate 18, are maneuvered back and forth over base plate 12 by activating actuator 36. Thus, before the pleat is sewn into place, actuator 36 withdraws the plates from the sewing area.

A pleat forming method according to the present invention will now be described by way of reference to FIGS. 1–7. This method may be practiced to form four-fold center pleats using the embodiment depicted in FIG. 8.

Figure 1:
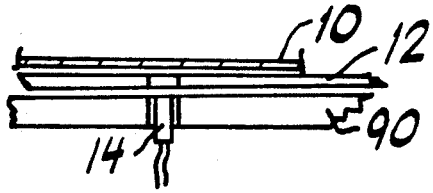
FIG. 1 is an end view of a section of yoke panel material positioned on top of a base plate.
Figure 11:
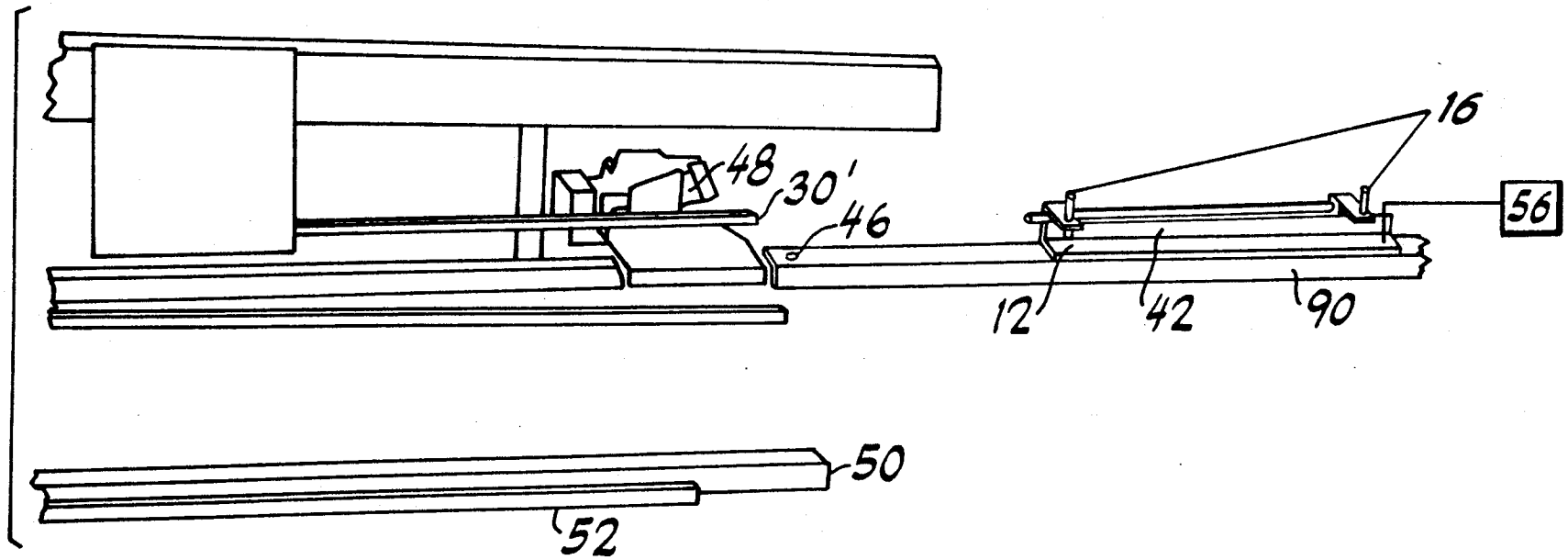
FIG. 11 is a side view of the transport system that incorporates the pleating mechanism.

As shown in FIG. 1, a first material 10 is positioned over a base plate 12 which is mounted on supporting structure 90. Sensor 14 detects when first material 10 is in place on the base plate 12. Base plate 12 may be maneuvered by using known techniques, such as, but not limited to, actuator 56, (see FIG. 11) or belt driven systems.

Figure 2:
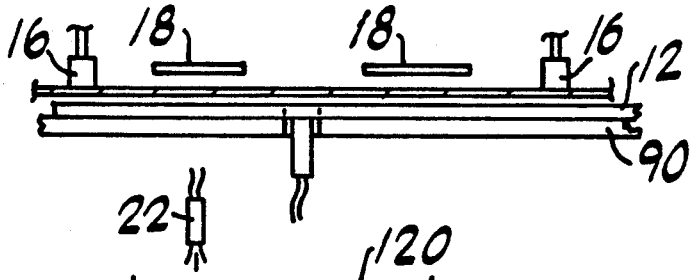
FIG. 2 is an end view of the embodiment shown in FIG. 1 where folding plates are positioned above the yoke panel material and clamps holding the yoke panel material in place.

After first material 10 is in position, material 10 is secured by clamps 16 and folding plates 18 are positioned over material 10 as shown in FIG. 2. It is preferable that folding plates 18 and the means of maneuvering folding plates 18 be attached to base plate 12.

Figure 3:
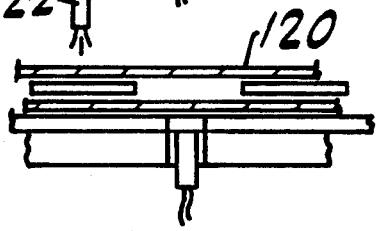
FIG. 3 is an end view of the section of yoke panel material set on the base plate and under the folding plates with a section of back panel material shown above the folding plates.

FIG. 3 shows a second material 20 next being positioned over folding plates 18. In the production of yoke-back panel assembly, second material 20 would be the back panel material. Sensor 22 indicates when second material 20 is in position.

Figure 4:
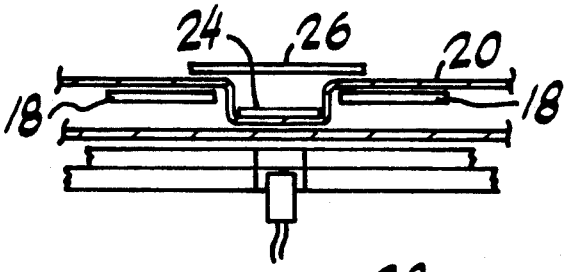
FIG. 4 is an end view of the embodiment shown in FIG. 3 where a lower plate has forced a portion of the back panel material below the folding plates while an upper plate secures a portion of the back panel material against the folding plates.

When sensor 22 detects the presence of second material 20, lower plate 24 and upper plate 26 are maneuvered into position as shown in FIG. 4. As it moves, lower plate 24 forces second material 20 between folding plates 18 in the direction of first material (or of base plate 22 if there is no first material 10) and clamps second material 20 against the surface below it. At the same time, upper plate 26 rest on a portion of second material 20 pressing that portion against folding plates 18

A this point, lower plate 24 and upper plate 26 should have been rotated or slid from a position away from base plate 12 to the position depicted in FIG. 4.

Figure 5:
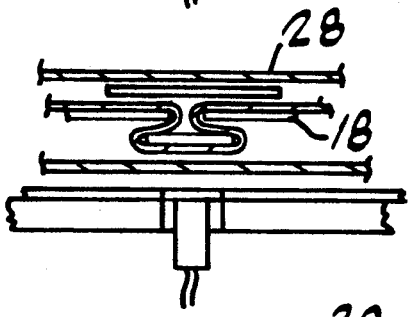
FIG. 5 is an end view of the embodiment shown in FIG. 4 after the folding plates have been moved together forming a pleat in the back panel material and after a second yoke panel material has been placed on top of the upper plate and the back panel material.

Thereafter, the pleat is formed in second material 20 by moving folding plates 18 in a direction toward each other and positioning folding plates 18 above lower plate 24 as seen in FIG. 5. Four folds are formed in second material 20. (In situations where there is only one folding plate 18, that plate 18 would merely move a distance over lower plate 24 causing two folds in second material 20.)

Also shown in FIG. 5 is third material 28 which is placed in position after the pleat is formed. In the production of yoke—back panel assemblies, third material 28 would be the other yoke panel material.

After the pleat has been formed and all of the necessary materials are in place, clamps 16 are released for a predetermined time and a predetermined distance to allow second material 20 and third material 28 (if it is used) to fall into alignment with first material 10 (if there is no first material 10 used, the edges of second material 20 fall flat on base plate 12). During the time that clamps 16 are released, a blast of air is delivered to the edges of the materials present to keep the edges down until clamps 16 are re-engaged securing the materials. The blast of air may be generated by any known means with the limitation that the blast be sufficient to orient material(s) in place without misaligning the configuration of the materials.

After first material 10, second material 20 and third material 28 (or whatever materials are being used in the particular configuration) are secured by clamps 16, base plate 12 is moved toward a sewing machine. This operation may be carried out in accordance with the transport system described in FIG. 11. The transportation and transferring processes, along with the associated apparatus, may be constructed in accordance with the patent application of Daniel Becker entitled "Method and Apparatus for Loading and Transferring Materials,"filed the same day as the application for the present invention, Ser. No 07/525,898, the disclosure of which is incorporated by reference.

The pleating unit, schematically represented by clamping mechanism 42, is slidably movable relative to the supporting structure 90. The pleating unit, clamping the workpiece, may then be passed to a transfer point in proximity to sensor 46 where second clamp 30' secures the material. Sensor 46 detects when mechanism 42 and the secured materials have reached the transfer point. As mechanism 42 moves the materials in the appropriate direction, bar clamp 30' moves in position to secure the materials after the materials and the clamps reach the transfer point.

When the materials trigger sensor 46, bar clamp 30' is engaged, and shortly afterward, mechanism 42 is released. As mechanism 42 moves back to the loading position, bar clamp 30' guides the material through the sewing machine 48 until the necessary stitching is complete.

It is preferable that the sewing machine be mounted on the supporting structure with mechanism 42 and that the supporting structure have a surface that accommodates the maneuvering of the materials toward the sewing machine. That is, as mechanism 42 and bar clamp 30' move toward the sewing machine, respectively, it is preferable that the material slide along the surface of the supporting structure.

Since the materials are draped across bars 50 and 52 at the end of the sewing operation, when bar clamp 30' is released, the material falls over bars 50 and 52 which may then be used to carry the materials away from the sewing location.

Figure 6:
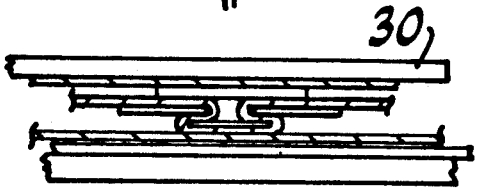
FIG. 6 is an end view of the embodiment shown in FIG. 5 after a bar clamp has been placed on the yoke-back panel material assembly.

As base plate 12 becomes adjacent to bar clamp 30', base plate 12 has been moving from its loading position to the transfer location, bar clamp 30' is positioned above the materials (10, 20 and 28, or some combination of those materials). When in position, bar clamp 30' is engaged to secure the material against the surface of the supporting structure as shown in FIG. 6.

Figure 7:
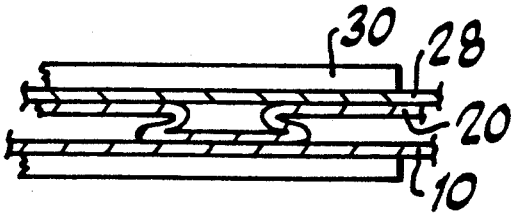
FIG. 7 is an end view of the yoke-back panel assembly with the bar clamp as panel assembly appears before it is sewn.

FIG. 7 illustrates the configuration of bar clamp 30' and the material after folding plates 18, lower plate 24 and upper plate 26 have been withdrawn from the materials and after the clamps 16 have been released. Base plate 12 and all of the features attached to it (including folding plates 18, lower plate 24 plate 26 and clamps 16) have been returned to their initial positions.

As base plate 12 is returned to the loading position, bar clamp 30' moves the materials through the sewing machine which sews the pleat in position. It is necessary for bar clamp 30' to secure the materials at a point where bar clamp 30' does not interfere with the sewing process but does hold the pleat in material 20 with sufficient proximity to keep the pleat accurate and parallel after the transfer from base plate 12 to bar clamp 30' and during the sewing process. The pleating process is completed after the pleat is sewn in place.

Figure 12:
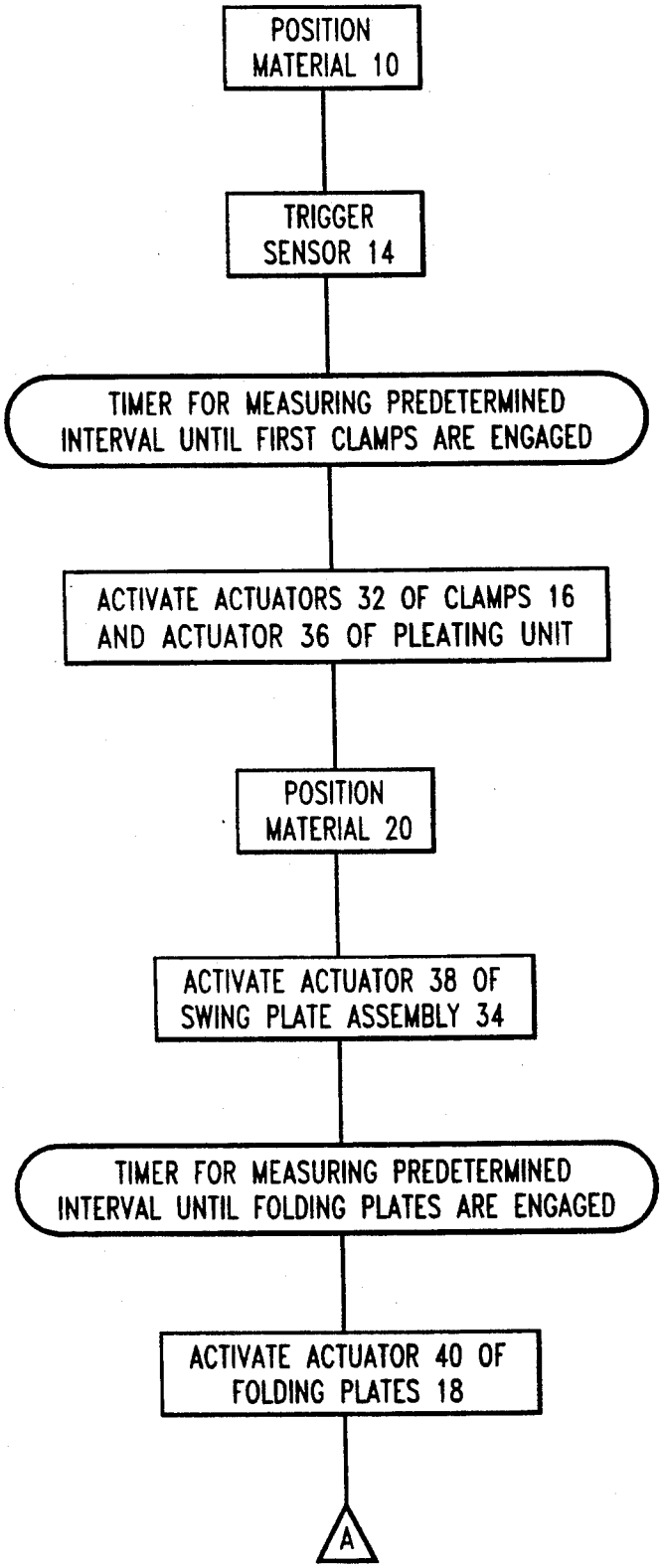
FIG. 12 (1 of 2 and 2 of 2) is a flowchart that characterizes the steps of the pleating and sewing operations according to one embodiment of the invention.
Figure 12:
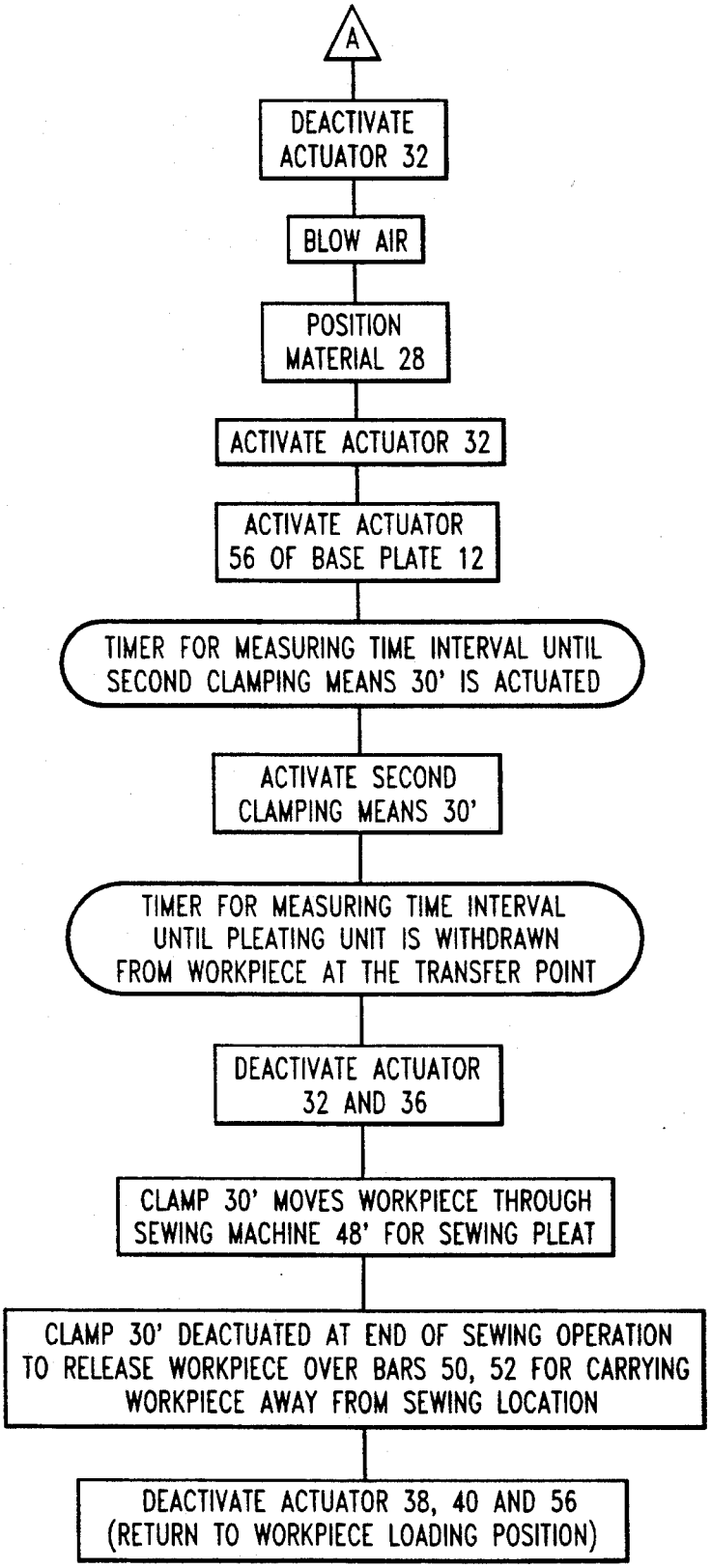

The flowchart in FIG. 12 (1 or 2 and 2 of 2) provides a schematic interpretation of a representative pleat forming, transporting, and sewing process in accordance with the invention. First, the yoke is positioned to trigger the sensor. After a predetermined time interval, the first clamps are engaged and the folding plates are maneuvered in position. The back material is positioned and the operator, or a sensor, may activate the swing plate assembly actuator. After another time interval, an actuator moves the folding plates over the lower plate to form the pleat. The second yoke is placed over the back panel and the operator releases the first clamp to secure the additional materials (air is blown to temporarily secure the edges of the first yoke while the other material falls in place). After re-clamping, the materials are moved to the transfer point. The pleating unit is withdrawn after a second clamp secures the materials.

Finally, the pleating unit returns to the loading position as the second clamp maneuvers the materials through the sewing machine.

One skilled in the art would realize that some of the activities performed during this operation may be performed by other means than the preferred means depicted in the drawings. For instance, any known means, for example, mechanical, electromechanical, or manual means, may be used to engage clamps 16 or position folding plates 18 and swing plate assembly 34. Positioning of the materials may be accomplished by a number of means, however, a manual means is contemplated for this particular embodiment. The movement of the plates may be activated manually by the operator or automatically by the signal from sensor 22. In addition, the size of plates would depend on the type and number of pleats desired.

The inventive mechanism is easily adapted to both current manufacturing methods and automated equipment designs. In addition, other embodiments are, of course, contemplated within the scope of the invention. For example, the embodiment illustrated in FIG. 9 is used to form double two-fold side pleats. Instead of a single rotary actuator and only one swing plate assembly, this embodiment utilizes two independent upper plates 26 and lower plates 24 that are maneuvered by rotating actuators 32. In addition, folding plates 18 are moved in and out of the folding position by the use of independent actuators 40, spaced the necessary distance apart. The other features of this embodiment are similar to the embodiment illustrated in FIG 8.

When forming pleats in the production of assemblies other than yoke—back panel assemblies, additional or fewer panels may be required. For example, second material 20 may be the only material used in a pleating required operation. That is, if the operator were pleating a material that would need not be sewn to other materials during the pleating process, the operator would not need to position the first material 10 under folding plates 18. The pleating process would be conducted using only second material 20 and the resulting configuration, after the sewing process, would be a single panel material with a predetermined number and style of pleats sewn in place.

Although illustrative preferred embodiments have thus been described herein in detail, it should be noted that numerous variations may be made within the scope of this invention. The terms and expressions have been used as terms of description and not terms of limitation. There is no intention to use the terms or expressions to exclude any equivalents of features shown and described or portions thereof and the invention should be defined in accordance with the claims which follow.

I claim:

1. A method for forming a pleat in material and sewing said pleat, comprising the steps of:

a) positioning said material above a folding plate;

b) clamping down said material, and with a lower plate forcing a portion of said material below said folding plate in a proximity of said folding plate and with an upper plate clamping said material against said folding plate;

c) moving said folding plate a predetermined distance horizontally above said lower plate while said upper plate provides a frictional resistance to a movement of a portion of said material whereby a pleat is formed in said material;

d) clamping said material in the pleated configuration;

e) removing said folding plate, said upper plate and said lower plate; and f) sewing said material, thus forming a sewn pleat.

2. A method for forming a pleat in material and sewing said pleat in place, comprising the steps of:

a) positioning a first material on a base plate;

b) position two folding plates above said first material while clamping said first material in place;

c) positioning a second material above said first material and on top of said folding plates;

d) clamping down on said second material with a swing plate assembly comprising a lower plate and an upper plate such that said lower plate forces a first portion of said second material down in between a predetermined space separating said folding plates until said second material is below said folding plates as said upper plate clamps a remaining second portion of said second material against said folding plates;

e) moving said folding plate a predetermined distance horizontally above said lower plate forming a pleat in said first portion of said second material during movement of said folding plates;

f) position a third material above said second material and on top of said upper plate;

g) unclamping said first material for a predetermined time;

h) clamping the edges of said first, said second and said third materials in place; and i) sewing the pleat along said edges.

3. An apparatus for folding a pleat in a material, comprising:

a) a supporting structure;

b) a base plate mounted slidably on said supporting structure;

c) a folding plate attached slidably to said base plate and positioned in close proximity to an upper surface of said base plate;

d) a swing plate assembly comprising a transferable lower swing plate and a transferable upper swing plate movably attached to said base plate;

e) means for maneuvering said lower swing plate from a first position above and away from said base plate and said folding plate to a second position between said base plate and said folding plate to position a first position of said material below said folding plate, and for maneuvering said upper swing plate from a first position above and away from said folding plate to a second position toward and proximate said folding plate;

f) means for maneuvering said folding plate horizontally above said lower plate a predetermined distance and said folding plate pushing said first portion of said material between said lower swing portion of said upper swing plate, forming a pleat, while said upper swing plate provides a frictional resistance to the movement of a remaining portion of said material; and g) means for retracting said base plate, swing plate assembly and said folding plate leaving said pleat clamped in position in said material.

4. An apparatus for folding a pleat in a material, comprising:

a) a supporting structure;

b) a base plate mounted on said supporting structure and slidable from a loading position to a transfer position;

c) two folding plates slidably attached to said base plate and slidable from a first position in spaced proximity to said base plate to a second position above an upper surface of said base plate, with a lower surface of said folding plates facing the upper surface of said base plate to define a space between said folding plates and said base plate for a first panel material;

d) a swing plate assembly comprising a transferable lower swing plate and a transferable upper swing plate rotatably and slidably attached to said base plate;

e) a first set of clamps having open and closed positions and attached to the edges of said base plate for securing said first panel, said clamps being in a closed position when securing the said first panel material on said base plate;

f) means for temporarily securing said material and subsequent materials when said first clamps are in an opened position to add said subsequent materials on said base plate;

g) means for maneuvering said upper and lower swing plates, wherein said lower swing plate is maneuvered in an arcuate path, after a second material has been placed over said folding plate, back and forth from a first position away from said base plate and said folding plate to a second position between said base plate and said folding plates by passing through a predetermined spacing between said folding plates and forcing a first portion of said second material below said folding plates, and wherein said upper swing plate is maneuvered back and forth from a first position away from said base plate and said folding plates to a second position above said folding plates resting on said second material; and h) means for maneuvering said folding plates horizontally above said lower swing plate a determined distance to form a pleat into said first portion of said second material while said upper swing plate provides a frictional resistance to the movement of a remaining portion of said second panel material.

5. An apparatus as recited in claim 4, wherein a temporary means of orienting said material when said first clamps are in an opened position is provided by a blast of air.

6. A system for forming a pleat, including, in combination, an apparatus according to claim 4 and a stitching means for stitching the formed pleat.

* * * * *

UNITED STATES PATENT AND TRADEMARK OFFICE

CERTIFICATE OF CORRECTION

PATENT NO. : 5,148,760

DATED : September 22, 1992

INVENTOR(S) : Takashi Miyauchi

It is certified that error appears in the above-identified patent and that said Letters Patent is hereby corrected as shown below:

The claims should be corrected as follows:

Column 8:

Claim 3, paragraph f), line 5, "portion of" should be --plate and--;

Column 9:

Claim 4, paragraph g), lines 4 and 6, "plate" should be --plates--.

Signed and Sealed this

Twelfth Day of October, 1993

*Attest:*

*Attesting Officer*

BRUCE LEHMAN

*Commissioner of Patents and Trademarks*